United States Patent [19]

Castel et al.

[11] 4,239,087

[45] Dec. 16, 1980

[54] DRILL BIT WITH SUCTION JET MEANS

[75] Inventors: Yvon Castel, Pau; Henri Cholet, Le Pecq, both of France

[73] Assignee: Institut Francais du Petrole, France

[21] Appl. No.: 872,455

[22] Filed: Jan. 26, 1978

[30] Foreign Application Priority Data

Jan. 28, 1977 [FR] France ..... 77 02689

[51] Int. Cl.[2] ..... E21B 10/18

[52] U.S. Cl. ..... 175/340; 175/67

[58] Field of Search ..... 175/65, 67, 70, 100, 175/213, 339, 340, 325, 393, 408, 422; 299/81; 239/591

[56] References Cited

U.S. PATENT DOCUMENTS

| | | | |
|---|---|---|---|
| 3,070,182 | 12/1962 | Runte | 175/339 |
| 3,111,179 | 11/1963 | Albers et al. | 239/591 |
| 3,563,324 | 2/1971 | Lauber | 175/393 |
| 3,945,446 | 3/1976 | Ostertag et al. | 175/323 |
| 4,022,285 | 5/1977 | Frank | 175/340 X |

FOREIGN PATENT DOCUMENTS

| | | | |
|---|---|---|---|
| 2529380 | 1/1976 | Fed. Rep. of Germany | 175/340 |

*Primary Examiner*—Ernest R. Purser

*Attorney, Agent, or Firm*—Craig and Antonelli

[57] ABSTRACT

This drill bit comprises a plurality of rollers provided with cutting teeth or inserts.

At least one upwardly directed eduction jet is created and the bit comprises at least one nozzle located between two adjacent rollers and creating at least two fluid jets respectively directed towards these two adjacent rollers.

13 Claims, 10 Drawing Figures

DRILL BIT WITH SUCTION JET MEANS

Figure 1:
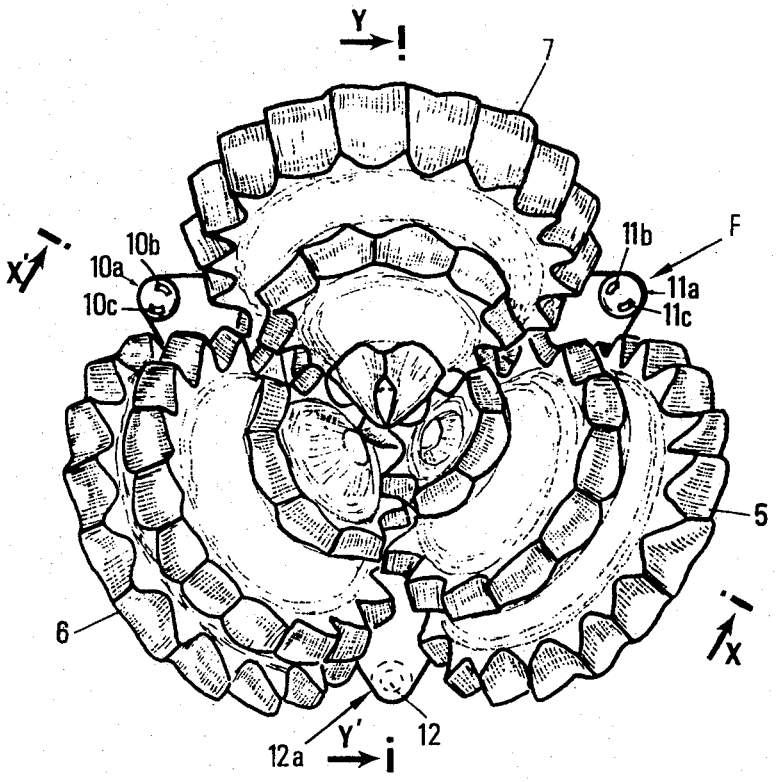

The present invention relates to a drill bit. More particularly, but not limitatively, the present invention relates to a drill bit which can be secured to the lower end of a drill string. The bit according to the invention is of a type comprising a plurality of rotatable elements provided with cutting teeth or inserts, such rotatable elements being for example cone-type cutters mounted on roller bearings having axes of rotation inclined with respect to the central axis of the drill bit.

In the past the efficiency of such drill bits used for drilling ground formations has been improved by the simultaneous action of fluid jets impinging on the hole bottom between the different free spaces separating the cutters.

At the bit level, this drilling fluid is mainly responsible for cooling the bit, and cleaning it as well as the hole bottom and rapidly conveying the ground cuttings towards the annular space between the drill string and the wall of the drilled hole.

In a first type of prior art drill bits, the fluid jets are discharged at a substantial distance above the cutters. Thus before reaching the hole bottom, the jets flow through the drilling fluid already loaded with cuttings which fills the hole bottom. Consequently the flow velocity of the jets at this level is considerably reduced, which reduces their efficiency. Moreover the jets drive along a portion of the drilling fluid loaded with cuttings towards the hole bottom where the cuttings are re-grinded by the bit whose efficiency is thereby reduced. Furthermore the fluid jets create on the hole bottom an overpressure which packs the ground formations and it appears that the zone of contact between the drill bit and the hole bottom where the cuttings are formed is not sufficiently scavenged by the drilling fluid.

Various modifications have been proposed, in particular the above indicated drill bits have been so modified as to discharge the jets of drilling fluid as close as possible to the hole bottom and sometimes a jet has been added along the bit axis. However such improvements have not proved quite satisfactory: neither re-grinding of the ground cuttings can be obviated nor the overpressure at the level of the hole bottom.

In second type of prior art drill bits it has been proposed to combine the flushing means formed by fluid jets with suction means for the drilling fluid loaded with ground cuttings, these last mentioned means comprising a jet having a direction opposite to the direction of advance of the drill bit.

Thus the drill bit described in U.S. Pat. No. 3,111,179, comprises nozzles for providing flushing jets between the bit cutters, and suction or eduction jets fed from channels provided through the cutter carrying flanges or legs of the drill bit. In such a bit not only the flushing jets are discharged too far from the hole bottom, which results in the above-indicated drawbacks, but also the position of the suction jets is such that the discharged fluid impinges against the wall of the bore hole, which can lead to its destruction and thus neutralize to a large extent the suction effect of the jet. Moreover the spacing of the respective orifices of the suction jets and of the flushing jets, along the direction of the drill bit axis is small and this reduces considerably the action of the flushing jets.

U.S. Pat. No. 2,776,115 describes a tricone bit using one flushing jet and two eduction jets. The flushing jet is inclined towards the center of the hole bottom, i.e. towards the zone of convergence of the cutter axes and towards the free spaces between the cutters. As a result, the greatest part of the flushing fluid flows from one of such free spaces to the other without cleaning the zone of contact of the ground with the cutter teeth.

Thus the efficiency of the drill bits described in the above U.S. Patents is not substantially higher than that of the bits of the first mentioned type, which explains that such drill bits have not been developed on an industrial scale.

French Pat. No. 2,277,968 to the assignee describes a drill bit of the second type having a good efficiency which however uses a skirt separating the space close to the hole bottom from the annular space delimited between the bore wall and the drill string. Such an embodiment is particularly suitable to some applications, such as for drilling large diametered holes, for air drilling, etc., but its manufacture may present some difficulties with some additional drawbacks related to the fact that over a rather substantial length the drill bit has an outer diameter not substantially different from the bore hole diameter, wherefrom results risks of jamming the drill bit in some ground formations, particularly in soft formations.

The present invention has for object a drill bit so devised as to be free of the above indicated drawbacks, while showing at the same time a considerably increased efficiency with respect to prior art drill bits.

This object is achieved, according to the invention, with a drill bit comprising a body member rotatable by a bit holder, said body member being provided with an inner recess which can be supplied with a pressurized drilling fluid through the bit holder, a plurality of rotatable elements carried by the body member and provided with ground cutting means contacting the hole bottom, flushing means for delivering at least one flushing fluid jet directed towards the hole bottom said flushing means comprising at least a first calibrated aperture provided in said body member and in direct communication with said recess, and opening in a first space comprised between two adjacent rotatable elements, suction means for the drilling fluid which has flushed the rotatable elements, said suction means being adapted to deliver at least one upwardly directed fluid jet, said suction means comprising at least one second aperture provided in said body member and located above a second space comprised between two adjacent rotatable elements.

The drill bit according to the invention comprises at least one flushing nozzle located substantially in said first space, said nozzle being provided at its lower part with at least two apertures adapted to create fluid jets respectively directed towards the two rotatable elements between which said first space is defined.

Figure 7:
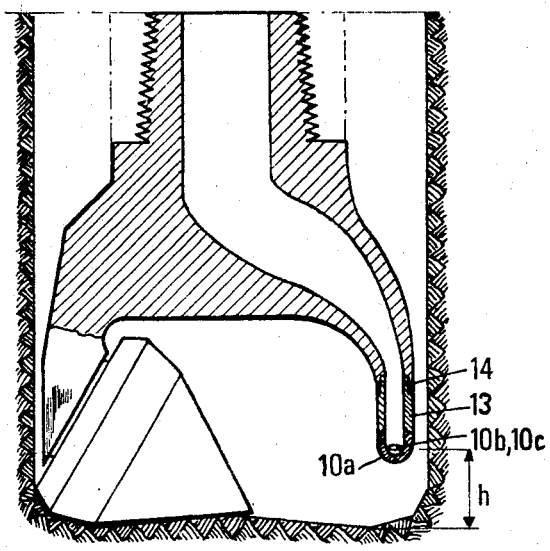
Figure 2:
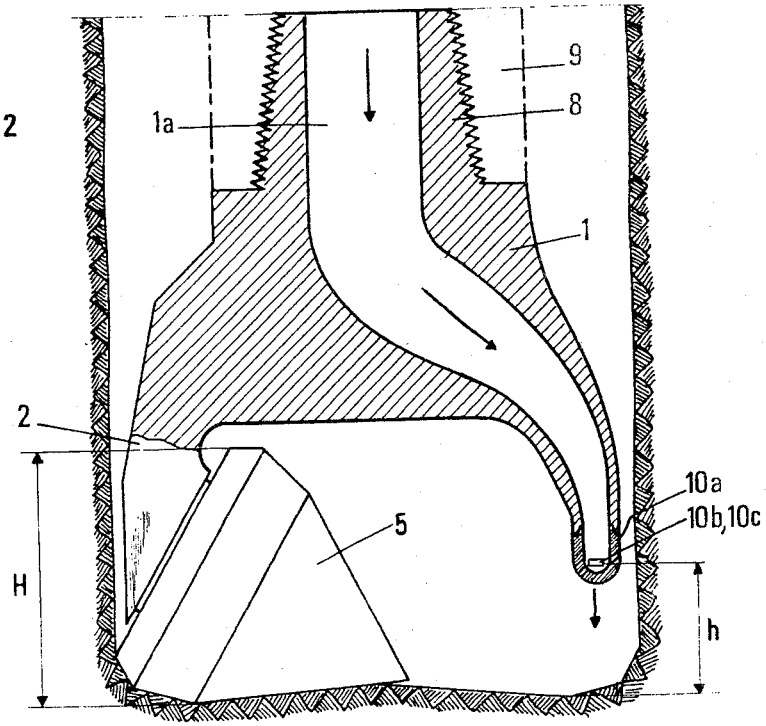
Figure 3:
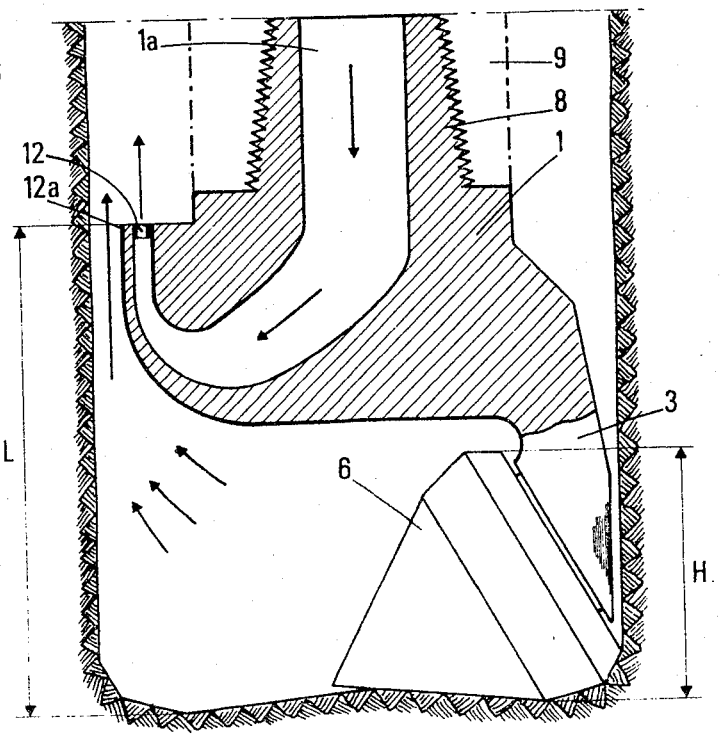
Figure 4:
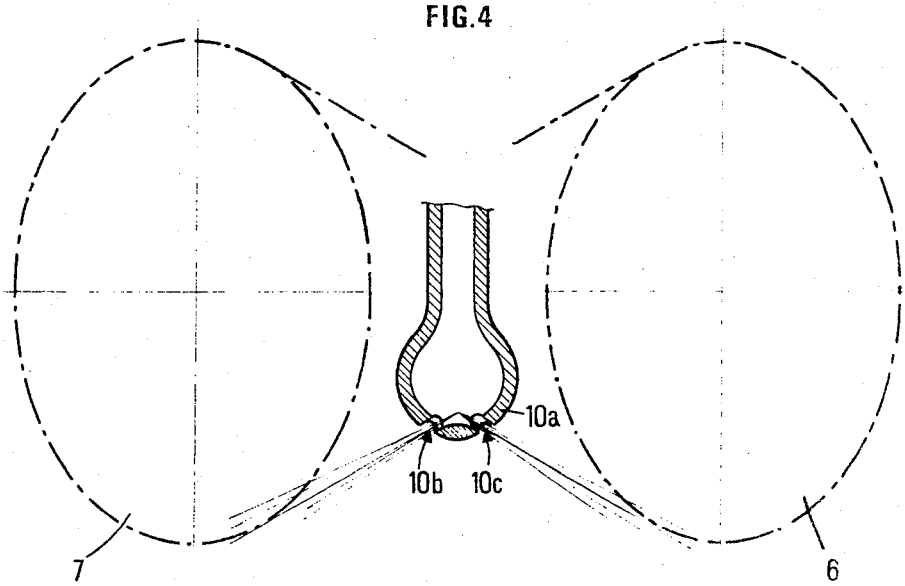
Figure 4A:
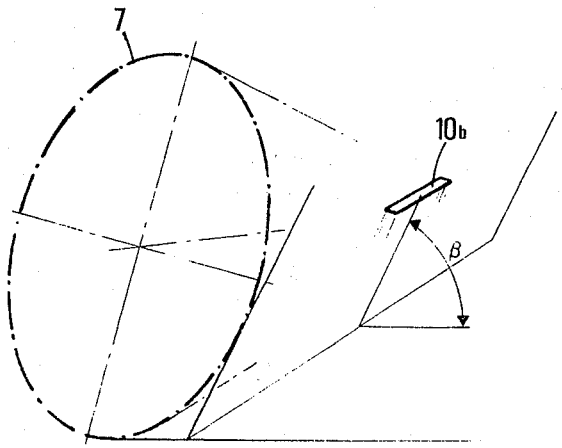
Figure 5:
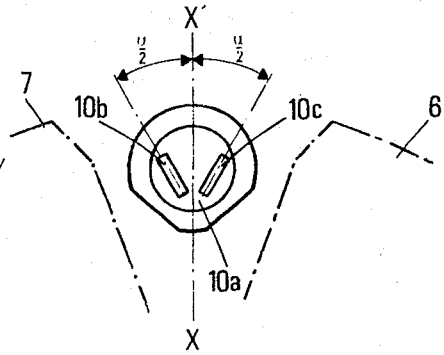
Figure 6:
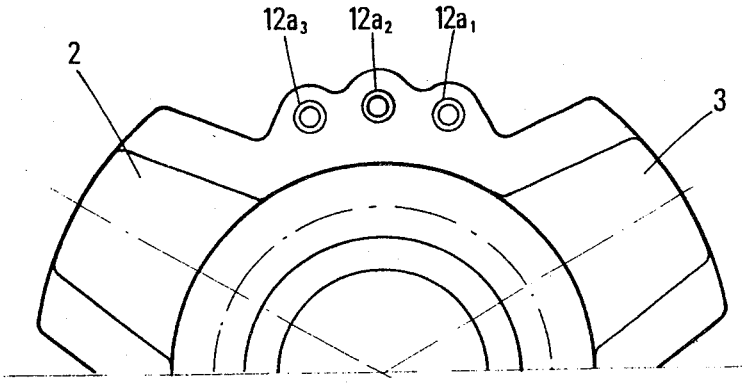
Figure 8:
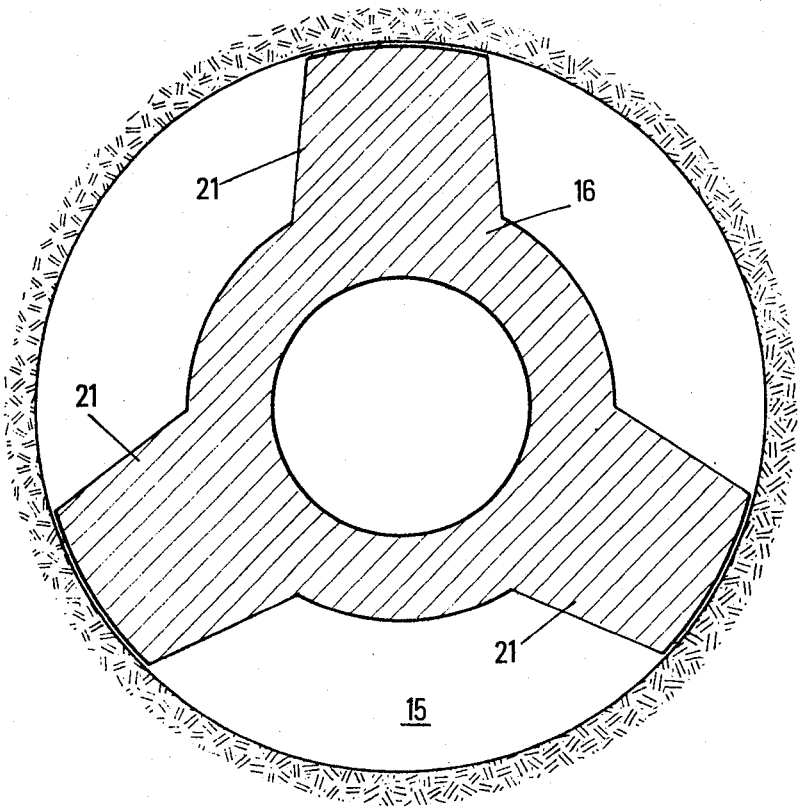
Figure 9:
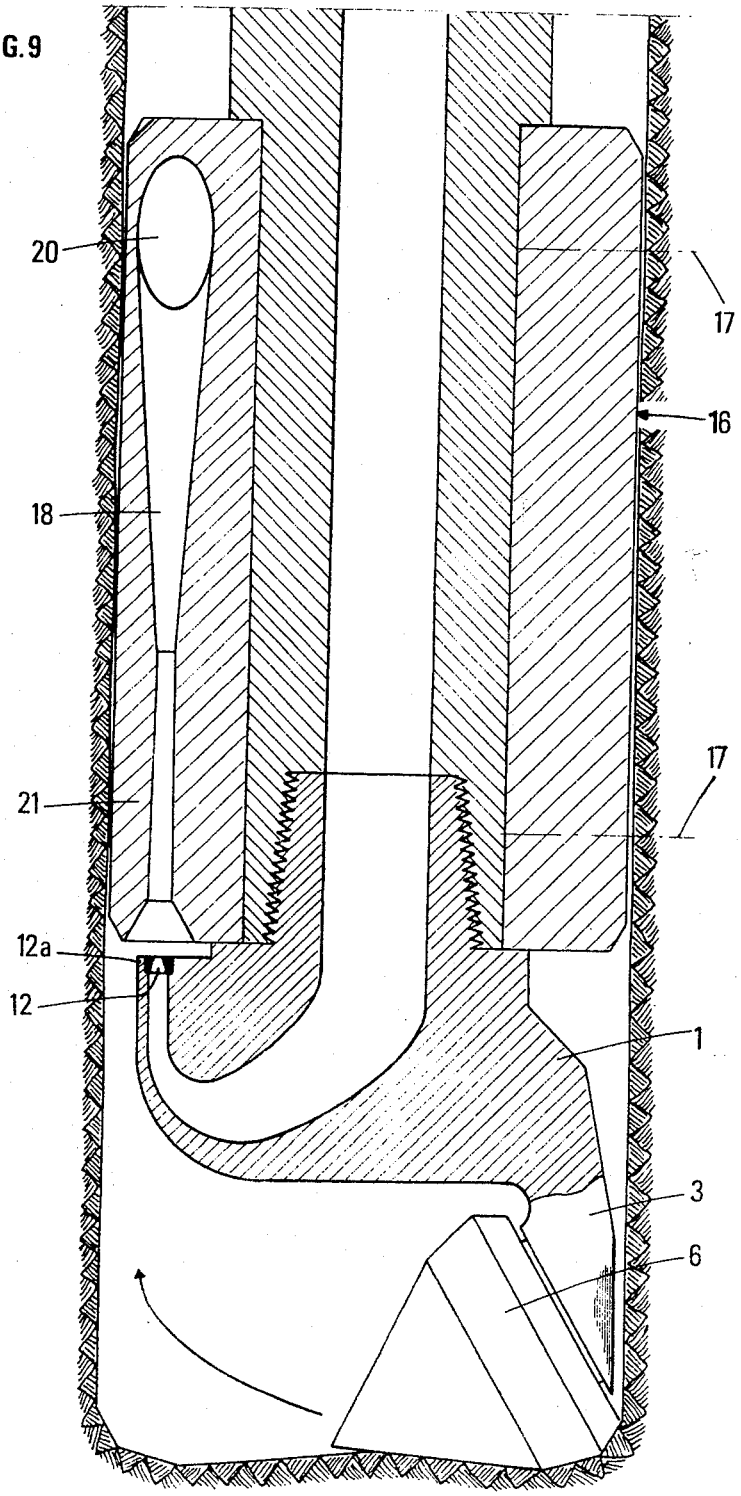

The invention will be clearly understood and all the advantages thereof made apparent from the following description illustrated by the accompanying drawings wherein:

FIG. 1 is a view from below of a drill bit according to the invention,

FIGS. 2 and 3 are cross-sectional views of this drill bit along lines X'X and Y'Y of FIG. 1 respectively, FIGS. 4,4A and 5 diagrammatically show the configuration of the flushing nozzles, FIG. 6 diagrammatically shows an alternative embodiment of the suction means, FIG. 7 diagrammatically illustrates an alternative embodiment of a flushing nozzle, FIG. 8 is a cross-sectional view of a stabilizing member which may be positioned above the drill bit, and FIG. 9 shows, in axial section, an embodiment of stabilizing member having a venturi provided in one of its blades.

The drill bit illustrated by the drawings comprises a body member 1 provided with three flanges or legs 2, 3 and 4, only two of which are shown in FIGS. 2 and 3. These legs carry ground cutting members formed, for example, by rollers or cone-type cutters 5, 6 and 7 rotatably mounted on (not illustrated) bearings and whose axes are inclined with respect to the vertical axis of the drill bit. Each of these rotatable elements may be of any known type and is provided with teeth, or inserts, as shown in FIG. 1, or with any other means for cutting the ground formations on the hole bottom.

The upper part 8 of body member 1 (FIGS. 2 and 3) is threaded to permit screwing the bit to a bit holder which rotates this bit.

This bit holder, indicated by reference numeral 9, can be formed by the drill string in the case of rotary drilling. When the drill bit is directly rotated by a bottom motor, the bit holder will be formed by the rotor of this motor.

Within the body member 1 of the drill bit is provided a recess 1*a* which directly communicates with the inner bore of the drill string.

Body member is provided with nozzles 10*a*, 11*a* and 12*a* having calibrated apertures 10*b*, 10*c*; 11*b*, 11*c* and 12 which communicate with recess 1*a*. Nozzles 10*a* and 11*a* are located in two of the free spaces between the cutters, preferably in the bissector planes of these free spaces. The couples of apertures 10*b*, 10*c*; 11*b*, 11*c* are so located that during the bit operation, the fluid feeding the recess 1*a* is discharged through these apertures 10*b*, 10*c*; 11*b*, 11*c* so as to form, in two of the free spaces comprised between the rotatable elements 5, 6, 7, pairs of jets for flushing the hole bottom, these jets having a component in the direction of advance of the drill bit in operation.

The third calibrated aperture 12 is so located that during operation of the drill bit the fluid is discharged above the third free space comprised between the rotatable elements 5, 6 and 7, forming an upwardly directed jet, i.e. a jet directed away from the hole bottom and having a suction or eduction effect. This rising jet creates a negative pressure in the annular space comprised between the upper coupling of the drill bit and the bore hole wall.

This creates a pressure difference between the hole bottom and the zone where the suction jet is located. This pressure difference substantially increases the upward flow of the mud loaded with ground cuttings, which flows very rapidly from the high pressure zone to the low pressure zone.

The cuttings are thus carried away from the hole bottom as soon as they are built and thus the drill bit remains permanently clean, whereby are achieved increased drill rates and a longer working life of the different parts of the drill bit (cutter teeth, bearings, etc. . . )

It may be advantageous, as illustrated by FIGS. 2 and 3, to supply the calibrated apertures 10*b*, 10*c*; 11*b*, 11*c* and 12 with drilling fluid from the recess 1*a* through ducts so designed as to reduce as much as possible the pressure drops in the fluid flow, particularly by a tangential connection to the wall of recess 1*a*.

In the embodiment illustrated by FIGS. 1 to 3, the calibrated apertures 10*b*, 10*c*; 11*b*, 11*c* and 12 are formed by the circular openings of nozzles 10*a*, 11*a* and 12*a* respectively.

FIGS. 4 and 5 diagrammatically show the configuration of the nozzles 10*a* or 11*a* wherethrough the flushing jets are discharged.

In FIG. 4 shows a vertical cross-section of the nozzle 10*a* located in the interval between the rotatable elements, as diagrammatically indicated in mixed lines. As shown in this drawing, nozzle 10*a* is provided with two apertures 10*b* and 10*c* so oriented that the fluid jets discharged through these apertures reach the rotatable elements in the immediate vicinity of the hole bottom. In other words, the axes of the jets discharged from the calibrated apertures 10*b* an 10*c* are substantially tangent to the rotatable elements 7 and 6 respectively.

These calibrated apertures may be circular but will preferably have the shape of slots, as shown in FIG. 5 which is partial view from beneath of FIG. 4.

Under these conditions, a maximum efficiency of the fluid jets can be reached by giving these slots a direction substantially parallel to the generatrix of the rotatable element or cutter reached by the fluid jet and so designing the slot that the jet covers the greatest possible length of this generatrix.

Excellent results can be obtained by inclining the flushing jets with respect to a plane perpendicular to the bit axis by an angle $\beta$ whose value, expressed in degrees, is within the interval from 110(h/H) to 150(h/H), h being the distance separating the apertures such as 10*b* and 10*c* from the hole bottom and H the height of the rotatable elements or cutters, 5, 6 or 7, measured in a direction parallel to the bit axis.

By way of example, XX' being the plane of symmetry or bissector plane between two rotatable elements or cutters, slots 10*b* and 10*c* may be symmetric with respect to said plane and form between each other an angle $\alpha$ which may be comprised between 35° and 40° for a tricone bit.

FIG. 6 is a top view of an alternative embodiment of the suction means which are then constituted by at least one group of adjacent nozzles $12a_1$, $12a_2$, $12a_3$, or more generally by suction means distributed over a wide angular interval, these adjacent nozzles being optionally replaced by a nozzle having of elongated cross-section extending over a wide angular sector. Three nozzles have been shown, but this number should not be construed as limitative.

Obviously the nozzles are removably secured and will be selected by the user in dependence with the flow rate and pressure of the flushing fluid.

Changes may be made without however departing from the scope of the present invention. For example, as shown by FIG. 7, the flushing nozzles such as 10*a* may be provided on an extension 13, secured to the bit body member through any known means such as a threading 14, this extension being easily interchangeable to permit adjustment of the distance h, within the limits of the above-defined interval, to the value selected by the user in dependence with the nature of the drilled geological formations.

It is also possible to place above the suction jet a device for increasing the upward velocity of the drilling fluid loaded with ground cuttings in the annular space delimited between the drill string and the bore hole wall.

This device for speeding up the upward flow of drilling fluid may comprise a venturi duct forming a hydroejector with the fluid suction jet.

In an embodiment such as illustrated by FIG. 8, as stabilizing member 16 is located just above the drill bit, this member comprising a plurality of blades defining between each other spaces 15 directly communicating with the annular space delimited between the bore hole wall and the drill string.

In such a case it may be advantageous to house a venturi duct 18 in one of the blades 21 of the stabilizing member 16, as illustrated by FIG. 9, the member 16 being then secured, through any suitable means, such as by screws 17, in such a position that the venturi duct 18 is substantially co-axial with the suction fluid jet. In this case the venturi 18 is advantageously in communication with the above-defined annular space through two ducts opening on the two radial walls of blade 21 through openings 20 inclined with respect to the axis of the drill bit to prevent the cuttings from falling back into the venturi when the flow of drilling fluid is interrupted.

The inclination of the edges of openings 20 relative to the axis of venturi 18 will advantageously be smaller than 45°.

What we claim is:

1. A drill bit comprising a body member rotatable by a bit holder, said body member being provided with a recess which can be supplied with a pressurized fluid through the bit holder, a plurality of rotatable elements carried by the body member and provided with ground cutting means in contact with the hole bottom, said body member being provided with flushing means for delivering at least one flushing fluid jet directed towards the hole bottom, said flushing means being in direct communication with said recess and opening in a first space comprised between two adjacent rotatable elements, and said body member also being provided with eduction means for the drilling fluid which has flushed the rotatable elements, said eduction means being adapted to deliver at least one upwardly directed fluid jet, said eduction means comprising at least one aperture provided in said body member and located above a second space comprised between two adjacent, rotatable elements, the flushing means of said drill bit comprising at least one flushing nozzle located in said first space, said nozzle being provided at its lower part with at least two apertures having substantially symmetrical locations on both sides of a bissector plane of said first space, said two apertures being adapted to create fluid jets respectively directed downwardly and towards the two rotatable elements between which said first space is defined, so as to contact said elements substantially at the hole bottom.

2. A drill bit according to claim 1, wherein said fluid jets created by said apertures of the nozzle have an orientation substantially tangential to the outer surface of said rotatable elements.

3. A drill bit according to claim 1, wherein said flushing jets have a direction inclined with respect to a plane perpendicular to the bit axis by an angle whose value, expressed in degrees, is comprised within the range from 110(h/H) to 150(h/H), h being the distance between said two apertures of the flushing nozzle and the hole bottom and H being the height of the rotatable elements measured parallelly to the bit axis.

4. A drill bit according to claim 2, wherein the rotatable elements are of substantially conical shape and said apertures are formed by slots which are substantial parallel to a generatrix of a rotatable element.

5. A drill bit according to claim 4, comprising three rotatable elements, wherein said slots form an angle of from 35° to 40° between each other.

6. A drill bit according to claim 1, wherein said education means comprise at least one group of adjacent substantially aligned calibrated apertures.

7. A drill bit according to claim 1, wherein said education means comprise at least one aperture of elongated cross-section.

8. A drill bit according to claim 1 comprising means for increasing the upward velocity of the ground located above said education means.

9. A drill bit according to claim 8, wherein said means for increasing the upward velocity of the ground cuttings comprises a venturi.

10. A drill bit according to claim 9, secured at the lower end of a drill string, associated with a stabilizing member comprising a plurality of blades, said stabilizing member being located above said drill bit, and said venturi being housed in one of said blades of this member and means for positioning said venturi just above said second aperture.

11. A drill bit comprising a body member rotatable by a bit holder, said body member being provided with a recess which can be supplied with a pressurized fluid through the bit holder, a plurality of rotatable elements carried by the body member and provided with ground cutting means in contact with the hole bottom, said body member being provided with flushing means for delivering at least one flushing fluid jet directed towards the hole bottom, said flushing means being in direct communication with said recess and opening in a first space comprised between two adjacent rotatable elements, and said body member also being provided with eduction means for the drilling fluid which has flushed the rotatable elements, said eduction means being adapted to deliver at least one upwardly directed fluid jet, said eduction means comprising at least one aperture provided in said body member and located above a second space comprised between two adjacent, rotatable elements, the flushing means of said drill bit comprising at least one flushing nozzle located in said first space, said nozzle being provided at its lower part with at least two apertures having substantially symmetrical locations on both sides of a bissector plane of said first space, said two apertures being adapted to create fluid jets respectively directed downwardly and towards the two rotatable elements between which said first space is defined, so as to contact said elements substantially at the hole bottom, and further comprising means for increasing the upward velocity of the ground cuttings located above said eduction means, said means for increasing the upward velocity of the ground cuttings comprising a venturi, the drill bit being secured at the lower end of a drill string and associated with a stabilizing member comprising a plurality of blades, said stabilizing being located above said drill bit, and said venturi being housed in one of said blades of this member and being positioned just above said aperture of said eduction means, wherein said venturi opens at its upper part through two orifices respectively located on the two radial walls of said blade of the stabilizing member.

12. A drill tool according to claim 11, wherein the edges of said two orifices of the venturi are inclined by at most 45° with respect to the axis of said venturi.

13. A drill bit comprising a body member rotatable by a bit holder, said body member being provided with a recess which can be supplied with a pressurized fluid through the bit holder, a plurality of rotatable elements carried by the body member and provided with ground cutting means for contacting the hole bottom, said body member being provided with flushing means for delivering at least one flushing fluid jet directed towards the hole bottom, said flushing means being in communication with said recess and opening in a first space defined between two adjacent rotatable elements, and said body member also being provided with eduction means for the drilling fluid which has flushed the rotatable elements, said eduction means being adapted to deliver at least one upwardly directed fluid jet, the flushing means of said drill bit comprising at least one flushing nozzle located in said first space, said nozzle being provided with at least two apertures adapted to create fluid jets respectively directed downwardly and towards the two rotatable elements between which said first space is defined, so as to contact said elements substantially at the hole bottom.

* * * * *